United States Patent [19]

Simpson

[11] 4,167,209

[45] Sep. 11, 1979

[54] BOILERS

[75] Inventor: David P. Simpson, Chester, England

[73] Assignee: The Electricity Council, United Kingdom

[21] Appl. No.: 849,922

[22] Filed: Nov. 9, 1977

Related U.S. Application Data

[62] Division of Ser. No. 685,480, May 11, 1976, Pat. No. 4,077,465.

[30] Foreign Application Priority Data

Aug. 15, 1975 [GB] United Kingdom ..... 32041/75

[51] Int. Cl.[2] ..... F28G 7/00

[52] U.S. Cl. ..... 165/1; 165/5; 165/84; 134/1; 134/22 C

[58] Field of Search ..... 165/DIG. 1, 84, 7, 5; 134/1, 22 C

[56] References Cited

U.S. PATENT DOCUMENTS

| | | | |
|---|---|---|---|
| 2,585,103 | 2/1952 | Fitzgerald | 134/1 X |
| 2,891,176 | 6/1959 | Branson | 134/1 X |
| 2,962,695 | 11/1960 | Harris | 134/1 X |
| 3,420,758 | 1/1969 | Scheer | 134/1 X |
| 3,517,674 | 6/1970 | Allen et al. | 134/1 |
| 3,789,617 | 2/1974 | Rannow | 165/84 X |
| 3,835,817 | 9/1974 | Tuomaala | 165/84 X |

*Primary Examiner*—Ira S. Lazarus

*Attorney, Agent, or Firm*—Beveridge, De Grandi, Kline & Lunsford

[57] ABSTRACT

A method of disrupting vapor films formed in film boiling in boilers, in which method transient electrical discharges are effected either in the boiler liquid or in a body of liquid in acoustic communication with the boiler liquid. The electrical discharges are effected at one or more selected locations in the boiler to produce shock waves which act on surfaces of the boiler liquid space where vapor films are to be disrupted. By disrupting such vapor films there is enabled an improvement in the heat transfer rates per unit area across the interface between the fire space and the liquid space of a boiler. There are also disclosed various arrangements in boilers for generating these shock waves. Electrical discharges may be effected between a pair of electrodes mounted in the boiler or between an electrode and an adjacent wall of the boiler, and several mounting configurations for electrodes in boilers are described.

8 Claims, 7 Drawing Figures

BOILERS

This is a division of application Ser. No. 685,480 filed May 11, 1976, now U.S. Pat. No. 4,077,465.

BACKGROUND OF THE INVENTION

The present invention relates to boilers and more particularly to methods of disrupting vapour films formed in film boiling in boilers and to boilers with means for disrupting such vapour films.

In conventional boilers, heat transfer rates across the interfaces between the fire space and the liquid space of the boiler can be limited by the phenomenon of film boiling. Film boiling is the forming of films of liquid vapour at the walls of the liquid space of the boiler. The presence of such vapour films significantly reduces the rates of heat transfer into the boiler liquid which can be maintained. In order to avoid film boiling, it has been necessary hitherto to allow for lower heat transfer rates per unit area across the interface between the fire space and the liquid space and to use, instead, relatively large areas of such interface to achieve desired total heat transfer rates. This results in boilers being relatively large, containing for instance, very great lengths and quantities of liquid tubes, to provide the necessary area of interface.

SUMMARY

According to one aspect of the present invention, a method of disrupting vapour films formed in film boiling in boilers comprises the step of effecting transient electrical discharges in the boiler liquid at at least one selected location in the boiler such that shock waves produced by the discharges act on surfaces of the boiler liquid space where vapour films are to be disrupted.

The use of transient electrical discharges in a liquid to produce shock waves in the liquid is described in our copending United States Patent Application Ser. No. 675,415. In the specification of that application, there is described a method and apparatus whereby transient electrical discharges are employed to increase the contact area between the phases in a multiphase system.

In the present invention, the transient electrical discharges produce shock waves in the boiler liquid which, when they act on surfaces of the boiler liquid space where vapour films tend to form, are effective to disrupt these films and inhibit their production. Thus, with the method of the invention, higher rates of heat transfer can be maintained in a boiler without the formation of vapour films. Higher heat transfer rates can, in turn, enable boilers to be manufactured which are smaller for the same steam output, in the case of a water boiler.

According to another aspect of the present invention, a boiler having a fire space and a liquid space comprises means for effecting transient electrical discharges in boiler liquid at at least one selected location in the liquid space such that, in use, shock waves produced in the boiler liquid by the discharges act on surfaces of the liquid space where vapour films formed in film boiling can be disrupted thereby.

The present invention has its chief application in water boilers, but it will be understood that the invention is not limited to the boiling of water to make steam. Accordingly, where "liquid" is used herein in terms such as "boiler liquid", "liquid to be boiled", and "liquid space" it should be construed in the present context to cover not only water but also other liquids to be boiled.

The transient electrical discharges may be effected directly in the boiler liquid. However, especially where the liquid to be boiled is unsuitable for the production of discharges therein, the discharges may be effected in a body or liquid, conveniently water, which is separated from the liquid to be boiled, but in acoustic communication therewith, by means of an acoustically transmissive diaphragm or membrane. In this case, it will be appreciated that the body of liquid in which the discharges are effected does not form a part of the liquid to be boiled (i.e. the boiler liquid).

The electrical discharges may be formed at the or each selected location in the boiler between a respective pair of electrodes. However, instead, only a single electrode may be provided at each location, the discharge then taking place between the electrode and an adjacent wall of the boiler. For instance, the discharge may be arranged to take place between an electrode and the interior wall of a pipe of a liquid tube boiler.

It will be understood that although the shock waves are generated by the electrical discharges in the boiler liquid itself or in the body of liquid in acoustic communication with the boiler liquid, these shock waves will be transmitted into the walls of the liquid space. The shock waves can therefore be transmitted along the walls of the liquid space, such as along a liquid tube, and will tend to generate secondary shock waves in the boiler liquid.

Examples of the present invention will now be described with reference to the accompanying drawings.

DETAILED DESCRIPTION

Figure 1:
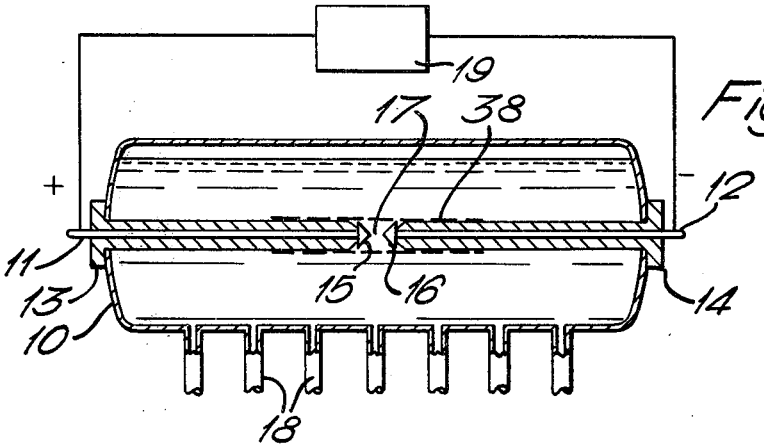
FIG. 1 illustrates an arrangement of the invention with a pair of electrodes incorporated in a feed drum or header for a boiler containing water.

Referring to FIG. 1, there is illustrated a feed water drum on a header 10 for a boiler in which there are mounted two electrodes 11 and 12 extending substantially coaxially with one another through openings in opposite ends of the drum 10. The electrodes are mounted in respective insulators 13 and 14 so as to be electrically insulated from the walls of the drum 10. The insulators extend along the shaft of the electrodes 11 and 12 so as to expose only conical heads 15 and 16 of the electrodes. The heads 15 and 16 are spaced apart to define a spark gap 17 which is normally immersed in boiler water when the boiler is in use. Water tubes 18 extend from the feed water drum 10.

In operation a source 19, arranged to effect a transient high voltage between the electrodes to cause a discharge across the gap 17, is connected to the electrodes. When the boiler is in operation to produce steam, transient discharges are produced between the heads 15 and 16 which, in turn, produce shock waves in the body of boiler water in the drum 10. These shock waves impinge on the walls of the drum, including the wall portions adjacent the entrances to the water tubes 18, and are transmitted into the walls of the water tubes 18. The shock waves are then transmitted along the water tubes and tend to produce secondary shock waves in the water in the water tubes. The combined effect of the shock waves being transmitted in the water along the tubes and also in the walls of the tubes tends to inhibit the forming of vapour films due to film boiling at the water tube interior surfaces and also to disrupt such vapour films if formed.

Figure 2:
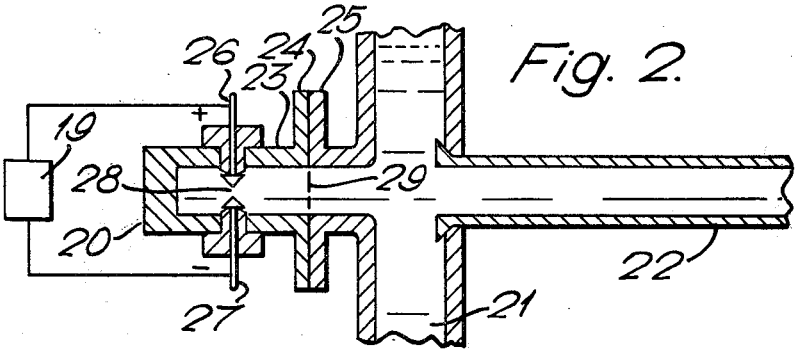
FIG. 2 illustrates an arrangement in which an independent shock wave generator having a pair of electrodes can be mounted adjacent a water tube.

A different arrangement is shown in FIG. 2 in which a separate shock wave generator 20 is fastened to the wall of a header tube 21 at a location adjacent the entrance to a water tube 22. The shock wave generator 20 comprises a generally cylindrical body 23 closed at one end and having a flange 24 at the other end which is adapted to mate with and be fastened to a flange 25 provided on the wall of the header tube 21. The interior volume of the cylindrical body 23 is in communication with the interior of the header tube 21 and is, when the boiler is operative, filled with boiler water. Two electrodes 26 and 27 are mounted diagonally opposite each other in the cylindrical wall of the cylindrical body 23 and have heads spaced apart to define a spark gap 28. When a discharge is produced across the gap 28 by the source 19 of high voltage, the shock waves so generated are transmitted in the boiler water into the water in the header tube 21 and also along the water tube 22. As before, the shock waves are partly transmitted in the boiler water itself and partly along the walls of the water tubes.

Figure 3:
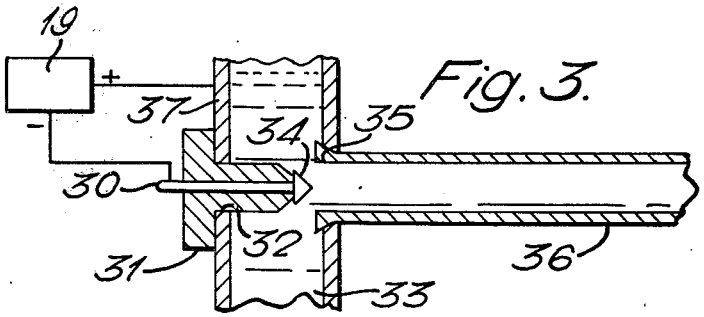
FIG. 3 illustrates an arrangement in which a single electrode is mounted adjacent the end of a water tube.

Instead of the arrangement of FIG. 2, a single electrode 30 (FIG. 3) may be mounted in an insulator 31 so as to extend through an opening 32 in the wall of a header tube 33. In FIG. 3, the electrode 30 has a conical head 34 disposed in the interior of the header tube 33 so as to be spaced from a swaged-over end 35 of a water tube 36. In operation, a transient high voltage is applied between the electrode 30 and the boiler water tube system, for instance at terminal 37, by means of the source 19 of transient high voltage. Thus, electrical discharges occur between the electrode head 34 and the end 35 of the water tube 36.

Figure 4:
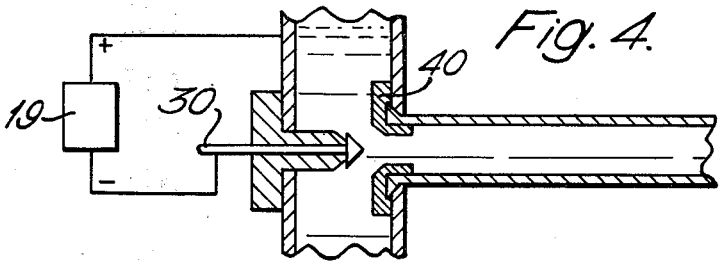
FIG. 4 illustrates an arrangement similar to that of FIG. 3 but including a replaceable collar mounted at the end of the water tube to form a second electrode.

In order to avoid excess corrosion of the water tube resulting from the discharges, a replaceable collar 40 (FIG. 4) may be provided in electrical contact with the end 35 of the water tube 36. The collar 40 then provides, in effect, a second electrode between which and the electrode 30 the electrical discharges take place.

Figure 5:
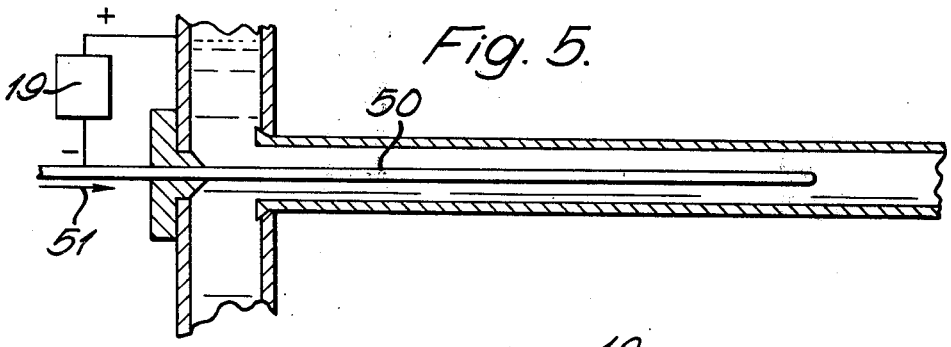
FIG. 5 illustrates an arrangement in which a long continuously fed electrode is provided extending in a water tube.

FIG. 5 illustrates a further arrangement in which a long rod electrode 50 is provided extending through an insulator mounted in an opening in the wall of the header tube 33. The rod electrode 50 is arranged to extend for a distange substantially coaxially along the interior of the water tube 36. Once again, a transient electrical voltage is applied by source 19 between the electrode 50 and the water tube system so that electrical discharges occur between the electrode 50 and the interior surface of the cylindrical wall of the water tube 36. However, in this arrangement, the discharges may occur randomly spaced along the electrode 50 and electrolytic erosion of the water tube is thereby reduced. Further, the electrode 50 may be continuously fed in the direction of arrow 51 into the water tube to compensate for its consumption by electrolytic erosion during use.

Figure 6:
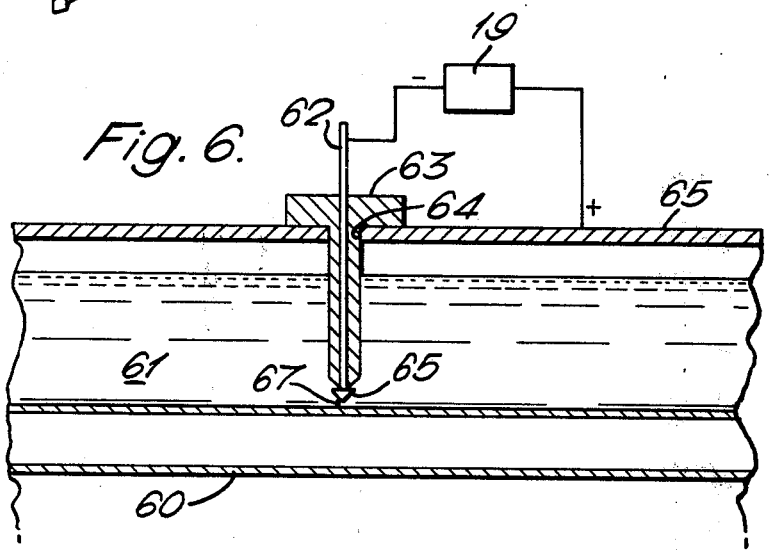
FIG. 6 illustrates an arrangement in which a single electrode is arranged to effect discharges to the wall of a fire tube in a fire tube boiler.

FIG. 6 illustrates an arrangement of the invention in a fire tube boiler. In the Figure, a fire tube 60 is shown extending through a water space region containing boiler water 61. An electrode 62 is shown extending in an insulator 63 through an opening 64 in a wall 65 of the boiler. The electrode 62 and insulator 63 are arranged so that a conical head 66 of the electrode is immersed in the boiler water 61 and is spaced from the outside wall of the fire tube 60 to form a spark gap 67. In operation, a transient high voltage is applied by source 19 between the electrode 62 and the metal work of the boiler so that discharges occur between the head 66 and the fire tube 60. Once again, the discharges produce shock waves in the water 61 which are effective to inhibit and disrupt vapour films which form at the surface of the fire tube 60.

Although in each of the above described examples of the invention the electrical discharges are arranged to take place directly in boiler water, it may be necessary to isolate the liqid in which the discharge is to take place from the liquid to be boiled in the boiler. In this case the liquid in which the discharge is to take place may be enclosed by an acoustically transmissive membrane made, for example, of stainless steel foil or a suitable rubber, and an example of this is indicated in FIG. 2 where an acoustically transmissive membrane 29 drawn in dashed line is disposed between flanges 24 and 25 to isolate the liquid in which the electrodes are immersed from the liquid which is to be boiled in the boiler. Alternatively, as shown in dashed line in FIG. 1, the electrodes may be sealed to a tube 38 of acoustically transmissive material.

Figure 7:
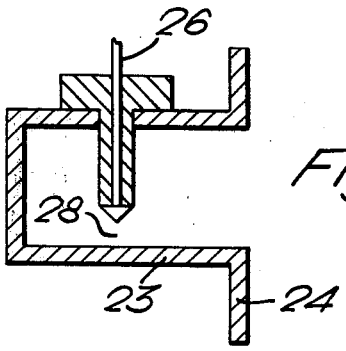
FIG. 7 illustrates a modified form of the shock wave generator of the arrangement of FIG. 2.

Whereas in FIG. 2 two electrodes are used in the shock wave generator 20, if desired, only one electrode can be used as shown in FIG. 7 and the discharges will then take place between this electrode and the cylindrical body 23 which will be formed of electrically conductive material, and which for the purpose of the present invention constitutes a wall of the boiler.

We claim:

1. A method of disrupting vapour films formed in film boiling in boilers having a fire space and a liquid space, the method comprising the step of effecting transient electrical discharges in a body of liquid in acoustic communication with the boiler liquid but separate from it and not constituting part of it, the discharges being effected at at least one selected location in the boiler such that shock waves produced by the discharges act on surfaces of the boiler liquid space where vapour films are to be disrupted.

2. The method of claim 1 wherein the separate body of liquid is water.

3. A method of disrupting vapour films formed in film boiling in boilers having at least one boiler tube containing a first liquid to be boiled and having a fire space around said tube and a liquid space forming a header containing said first liquid in direct communication with said tube, the method comprising the step of effecting transient electrical discharges in a body of a second liquid in acoustic communication with said first liquid in said liquid space but separated therefrom by an impermeable flexible acoustically transmissive membrane, the discharges being effected at at least one location selected such that shock waves produced by the discharges are transmitted by said second liquid and said membrane to the first liquid and into said tube in the axial direction thereof to be propagated along the walls thereof so as to act on surfaces of the boiler liquid space where vapour films are to be disrupted.

4. The method of claim 3 in which the second liquid is water.

5. A boiler comprising means defining a fire space; an acoustically transmissive membrane; means including said acoustically transmissive membrane defining a first liquid space in heat transfer relation with the fire space and a second liquid space in acoustic communication with the first liquid space but separated therefrom; and means within said second liquid space for effecting transient electrical discharges in a body of liquid therein at at least one location selected such that, in use, shock waves produced by the discharges are communicated to liquid in said first liquid space to act on surfaces of the first liquid space to disrupt vapour films formed in film boiling.

6. The boiler of claim 5 wherein the means for effecting transient electrical discharges comprises for the said at least one selected location a respective pair of electrodes between which electrodes the discharges are, in use, formed.

7. A boiler for boiling a first liquid comprising tubes forming interfaces between a liquid space for containing a first liquid and a fire space; a header connected to an open end of each tube; means defining an auxiliary chamber for containing a second liquid separated from the first liquid; means arranged to effect transient electrical discharges in said second liquid in the auxiliary chamber; an impermeable flexible acoustically transmissive membrane separating the second liquid in the auxiliary chamber from the first liquid in said header, said auxiliary chamber being positioned so that shock waves produced in the second liquid by the discharges are transmitted through the membrane into the first liquid and axially into said tubes to be transmitted along the walls thereof, thereby to disrupt vapour films formed in the liquid on the surface of said tubes.

8. A boiler as claimed in claim 7 including water in said auxiliary chamber.

* * * * *

UNITED STATES PATENT OFFICE

CERTIFICATE OF CORRECTION

PATENT NO. : 4,167,209

DATED : September 11, 1979

INVENTOR(S) : DAVID P.SIMPSON

It is certified that error appears in the above-identified patent and that said Letters Patent are hereby corrected as shown below:

Change the Foreign Application Priority Data from "32041/75" to --34021/75--.

Signed and Sealed this

*Twenty-second* Day of *January 1980*

[SEAL]

*Attest:*

SIDNEY A. DIAMOND

*Attesting Officer*

*Commissioner of Patents and Trademarks*